US005524788A

United States Patent [19]

Plester

[11] Patent Number: 5,524,788

[45] Date of Patent: Jun. 11, 1996

[54] CLOSURE WITH HIDDEN-GIFT COMPARTMENT

[75] Inventor: George Plester, Brussels, Belgium

[73] Assignee: The Coca-Cola Company, Atlanta, Ga.

[21] Appl. No.: 257,705

[22] Filed: Jun. 10, 1994

[51] Int. Cl.[6] ..... B65D 43/04; B65D 51/18

[52] U.S. Cl. ..... 220/522; 220/281; 220/212; 215/228

[58] Field of Search ..... 220/521, 527, 220/281, 375, 337, 339, 212, 23.83, 23.86, 254, 256, 257, 258; 215/6, 227, 228, 306

[56] References Cited

U.S. PATENT DOCUMENTS

| | | | |
|---|---|---|---|
| 2,766,796 | 10/1956 | Tupper . | |
| 2,965,496 | 12/1960 | Serdar | 220/521 X |
| 3,367,484 | 2/1968 | Nelson . | |
| 4,079,857 | 3/1978 | Crisci | 220/306 |
| 4,186,842 | 2/1980 | Albert | 220/306 X |
| 4,279,351 | 7/1981 | Vertes | 215/231 |
| 4,475,654 | 10/1984 | Fruchter | 220/521 X |
| 4,634,011 | 1/1987 | Polyblank . | |
| 4,795,056 | 1/1989 | Meyers | 220/281 X |
| 5,056,681 | 10/1991 | Howes . | |
| 5,064,073 | 11/1991 | Folland . | |
| 5,099,232 | 3/1992 | Howes . | |
| 5,117,995 | 6/1992 | Kau . | |

FOREIGN PATENT DOCUMENTS

| | | |
|---|---|---|
| 1054170 | 4/1953 | France . |
| 1121209 | 7/1956 | France . |
| 1287825 | 2/1962 | France . |
| 591155 | 4/1959 | Italy . |

*Primary Examiner*—Allan N. Shoap
*Assistant Examiner*—Nathan Newhouse
*Attorney, Agent, or Firm*—Birch, Stewart, Kolasch & Birch

[57] ABSTRACT

A closure for a beverage bottle includes a recessed compartment for accommodating a hidden prize or gift therein for promotional purposes. The compartment has an access opening with a snap-fit door therein. When the closure is on the beverage bottle the door can not be opened. However, when the closure is removed from the bottle it may be squeezed to snap open the door and provide access to the compartment to expose the prize or gift.

42 Claims, 4 Drawing Sheets

CLOSURE WITH HIDDEN-GIFT COMPARTMENT

The present invention relates to a closure for a container having a compartment therein for accommodating a prize, gift or the like, which is not accessible until the closure is removed from the associated container, but which is mounted on the outside of the closure, thus having no connection with the contents of the container. More specifically, the present invention relates to a screw or twist-off closure for a beverage bottle having an integral prize or gift compartment therein.

BACKGROUND OF THE INVENTION

Heretofore, numerous food and beverage packages have been designed including compartments therein for accommodating prizes, gifts or the like for promotional purposes. Packages of this type have been in various forms.

A common type of such a package is one wherein the prize compartment is disposed within a container and the compartment is made accessible by removing a separate closure of the container to provide access to the prize compartment.

Other types of these packages include prize compartments which are accessible without removing the closure through separate access means in the package.

A need in the art exists for a food or beverage package wherein a prize compartment can be formed as an integral part of a closure for the associated container which houses the food or beverage product, which is tamper-proof when the closure is on the container, which has no possible contact or connection with the container's contents, and which can be readily opened to expose the prize or gift when the closure is removed from the container.

SUMMARY OF THE INVENTION

Accordingly, it is a primary object of the present invention to provide a package for food or beverages which may be used for promotional purposes by providing a prize or gift compartment within a closure of the package which is not accessible until the closure is removed from the package.

It is another object of the present invention to provide a prize or gift compartment within a closure for a container which is isolated from the contents of the container so that there can be no possible contact with the product therein.

It is still a further object of the present invention to provide a closure for a container including a prize or gift compartment which is fabricated as one-piece or two-piece at minimal cost.

It is still another object of the present invention to provide a closure for a container including a prize or gift compartment which is easily handled by a consumer to reach the product in a conventional way, and which can be readily and separately opened to expose the prize or gift after the closure is removed from the container without impeding the consumer's access to the product.

These and other objects of the present invention are fulfilled by providing a closure for use with a container, said container having an access opening at one end thereof defined by surrounding sidewalls engageable with said closure comprising: a compartment within said closure for accommodating a prize or the like, said compartment having a predetermined first shape when the closure is on the container and in engagement with the sidewalls of said one end, closing said access opening, and being deformable to a second shape by compression thereof when the closure is removed from the container; and a door or panel means in said compartment secured in a closed position when the compartment has said first shape and movable to an open position in response to forces compressing the compartment to said second shape.

In a preferred embodiment the door or panel means includes a disc which is force-fit (snap-fit) into an aperture in the prize compartment when the prize compartment has the first shape, the disc popping out of the aperture when the compartment is compressed to achieve the second shape.

The disc may be separated from the closure, or connected to the closure along one edge such as by a hinge or it may be connected to the closure by an extensible link.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become more apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention and wherein.

DESCRIPTION OF PREFERRED EMBODIMENTS

Figure 1:
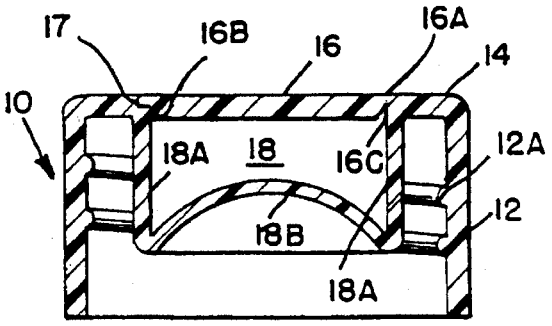
FIG. 1 is a cross-sectional view illustrating a first embodiment of a closure in accordance with the present invention.
Figure 1A:
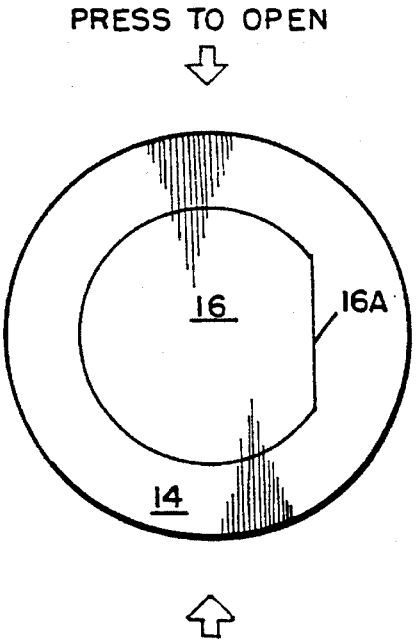
FIG. 1A is a top plan view of the closure of FIG. 1.

A first preferred embodiment of the present invention is illustrated in FIGS. 1 and 1A. A closure 10 having cylindrical sidewalls 12 with screw threads 12A for cooperative engagement with like threads on the finish of a conventional beverage bottle is shown.

Figure 6:
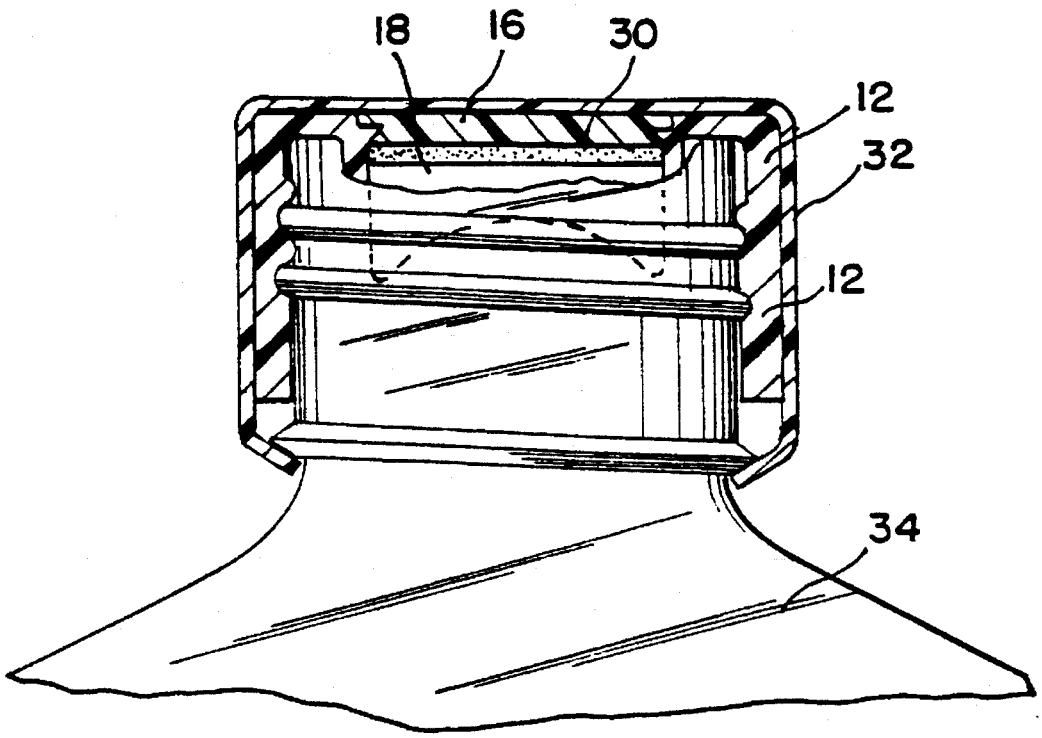
FIG. 6 is an elevational view partially in cross-section showing the closure on the FIG. 1 embodiment of the present invention secured to the finish of a conventional beverage bottle.

Closure 10 has a top annular surface 14 which defines a central access opening to a prize or gift compartment 18 concentrically disposed with respect to the sidewalls 12. Prize or gift compartment 18 includes cylindrical sidewalls 18A and a dome-shaped bottom wall 18B which is concave as viewed from the open end of closure 10. A door or panel 16 is provided in the access opening defined by annular surface 14. In the embodiment illustrated in FIG. 1 door 16 is secured by a living hinge 16A formed by an undercut 16C in the bottom of door 16. The door 16 is snap-fit to a closed position when the closure 10 has the configuration illustrated in FIG. 1 by a cooperative arcuate rib 17 and associated arcuate groove 16B. The shape of the closure 10 illustrated in FIG. 1 is the shape that the closure would maintain while secured to a beverage bottle such as that illustrated in FIG. 6. In that position door or disc 16 would be securely closed to preclude access to the prize or gift compartment 18. However, when closure 10 is removed from a bottle it may be compressed laterally in the direction of the arrows illustrated in FIG. 1A to distort its normal shape and cause door 16 to pop open and pivot about hinge 16A to provide access to the gift compartment 18. However, when in the closed position, the closure is in engagement with the finish of a beverage bottle such as illustrated in FIG. 6; and the closure 10 may not be distorted to open door 16 and provide access to the gift compartment. Of course entry into the gift compartment through door 16 could be obtained by forcible entry with a sharp or blunt implement, but this tampering would be evident in such a situation.

Figure 2:
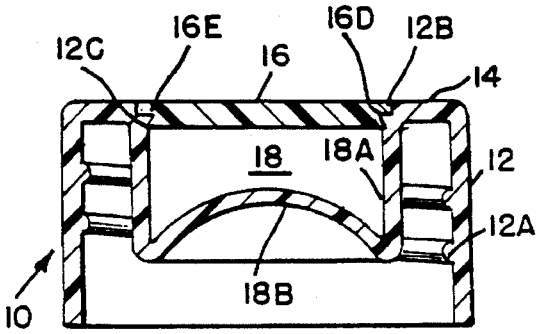
FIG. 2 is a cross-sectional view of a second embodiment of a closure according to the present invention.
Figure 2A:
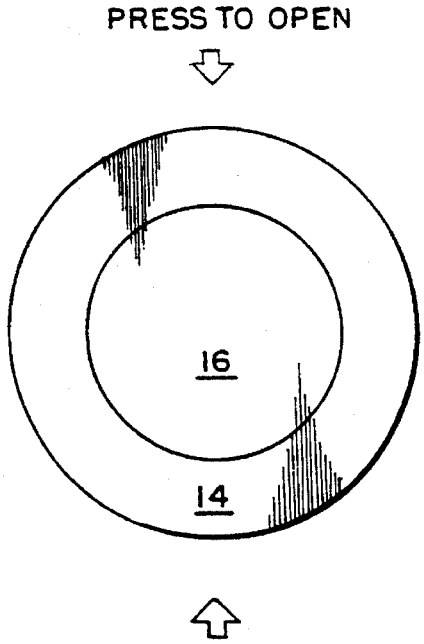
FIG. 2A is a top plan view of the closure of FIG. 2.

Referring to FIG. 2 there is illustrated a second embodiment of the closure of the present invention wherein like reference numerals refer to like parts. In this embodiment the door 16 is simply a disc which is snap-fit into the access opening of the closure and no hinge is provided. The disc or door 16 is secured therein by a cooperating acute angled rib 12B and groove 16D which extend approximately 180° around the periphery of the disc. The opposite or remaining 180° of the disc is provided with a right angle groove 16E and right angle rib 12C, which pops out of the access opening when compression forces are applied in the direction such as illustrated in FIG. 2A, more readily than the opposite side of the disc which is secured by cooperating acute angled ribs and grooves. Accordingly, when lateral compression is applied to compartment 18 the disc 16 will pop out of the opening and rock about the acute-angled rib and groove configuration as a fulcrum. The length of the arcuate acute-angled rib and groove configuration may or course be varied as desired without department from the spirit and scope of the present invention.

Figure 3:
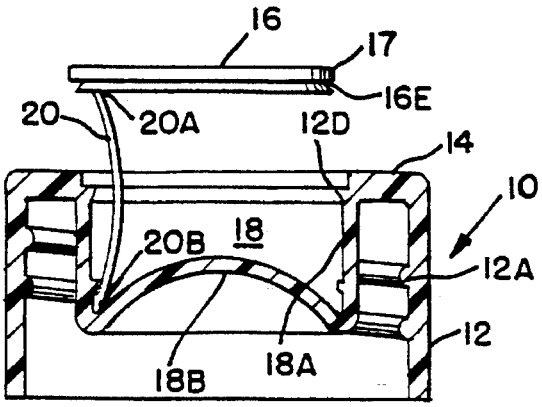
FIG. 3 is a cross-sectional view of a closure according to a third embodiment of the present invention.
Figure 3A:
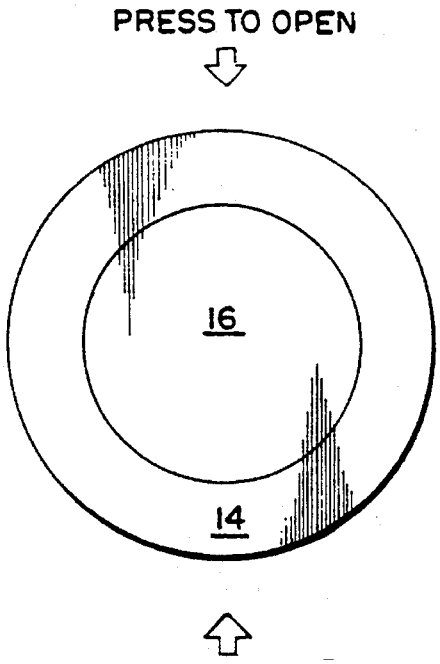
FIG. 3A is a top plan view of the closure of FIG. 3.

Referring to FIGS. 3 and 3A there is still another embodiment of the present invention wherein like reference numerals refer to like parts. The disc 16 is provided with a peripheral groove 16E around its entire periphery which cooperates with a peripheral rib 12D which extends around the access opening of the closure. Also provided is an extensible link 20 having a first end 20A secured to the underside of the disc 16 and a second end 20B secured within compartment 18 to one of its sidewalls 18A. The extensible link 20 keeps the disc 16 from totally separating from the remaining closure structure to avoid potential littering of the environment.

Figure 4A:
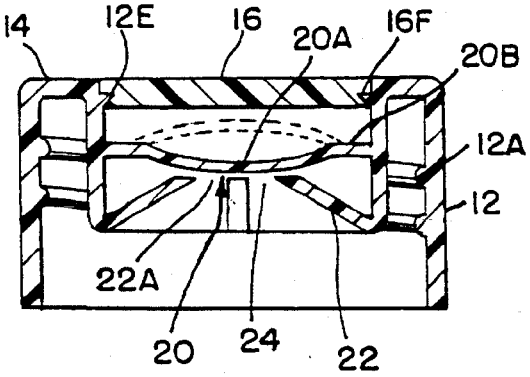
FIG. 4A is a fourth embodiment of a closure of the present invention shown in cross-section.

FIG. 4A discloses a fourth embodiment of the closure of the present invention. The disc 16 is provided with a peripheral groove 16F which cooperates with peripheral rib 12E to provide the necessary snap-fit into the access opening. In this embodiment the bottom wall of compartment 18 comprises a deformable diaphragm 20 including an annular peripheral web 20B and a central dome-shaped section 20A. As illustrated by the dotted line position when the closure of FIG. 4A is squeezed laterally the dome-shaped center section 20A will be pushed by the rotation of fingers 22 so that it will snap over center to the dotted line position and help release the disc 16 from the access opening.

Figure 4B:
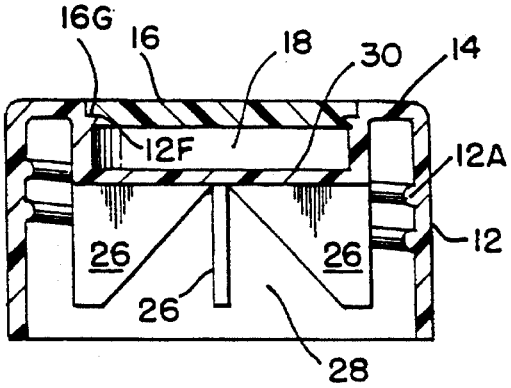
FIG. 4B is a cross-sectional view of a fifth embodiment of a closure of the present invention.

FIG. 4B illustrates a fifth embodiment of the closure of the present invention wherein the prize or gift compartment has a flat, or less curved, bottom 30 which is reinforced by a plurality of intersecting rings 26 having triangular cutouts 28 therein. These ribs 26 give rigidity to the bottom structure so that the closure 10 can be subjected to a pressure below the bottom 30 by the contents of container 34, and also enable the disc 16 to be more easily popped out of the access opening in order to expose the prize or gift in the compartment 18.

Figure 5B:
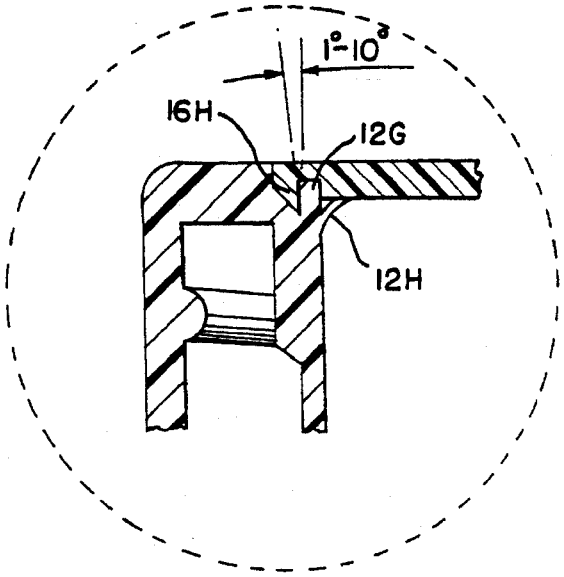
FIG. 5B is an enlarged view of details within circle 5B of FIG. 5.
Figure 5:
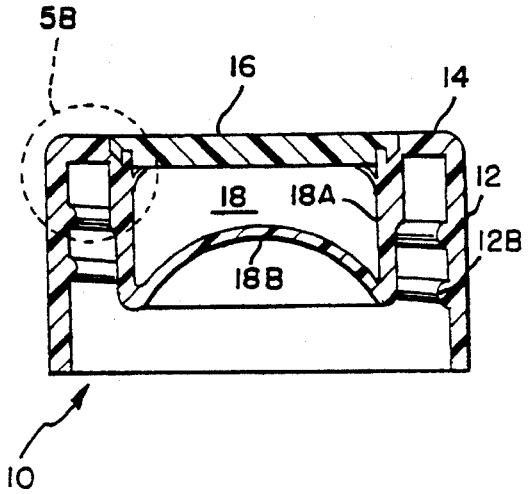
FIG. 5 is a cross-sectional view of a sixth embodiment of the present invention.
Figure 5A:
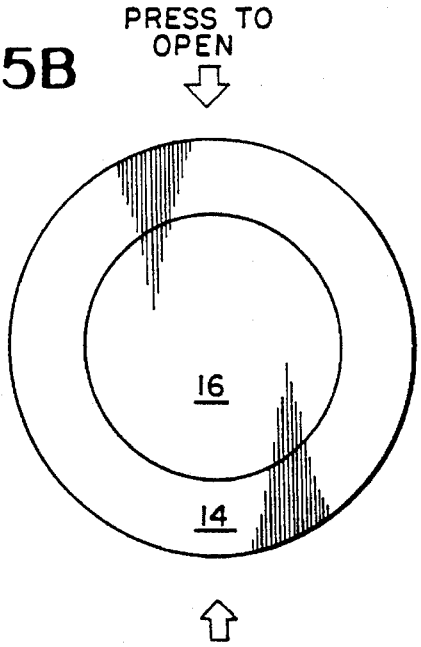
FIG. 5A is a top plan view of the closure of FIG. 5.

FIGS. 5, 5A, and 5B illustrate a sixth embodiment of the closure of the present invention, wherein the door 16 has a hooked snap-in undercut 16H and this engages a cooperating rib 12G, such as to put door 16 under tension when the closure 10 is subjected to high pressure by the contents of the container 34. This enables door 16 to provide the necessary stiffness to the closure 10 when this has to withstand high internal pressures within the container 34 and also makes tampering much more difficult. A feathered rim 12H molded on the sidewall 12 maintains a constant upward pressure on door 16, which is resisted in the normal, in-use situation when the closure 10 is under pressure and door 16 under tension, but assists opening when the closure 10 is removed from the container 34 and door 16 is no longer under tension. In this embodiment it is possible to construct door 16 so that it spontaneously springs open under the action of feathered rim 12H when closure 10 is removed from container 34.

Referring to FIG. 6 the operation of the closure of the present invention may be more readily understood. As illustrated in that figure when the closure such as that on the FIG. 1 embodiment is secured onto the finish of a beverage container 34, the closure cannot be laterally deformed such as illustrated in the direction of the arrows of FIG. 1A. In FIG. 6, standard features of the closing system of a beverage container 34 (which are state-of-art and not hitherto referenced for the sake of clarity) are shown, namely the sealing compound 30 of the closure 10 and the pilferproof band 32. Therefore, the disc or door 16 cannot be popped open unless one were to use a sharp or blunt implement and destroy the top of the closure. However, when the closure is removed from the bottle it may be laterally compressed as described hereinbefore to pop open the door or disc 16 to expose the contents such as prize 30 within the prize or gift compartment. A pilferproof ring 32 may be provided about the periphery of closure 10 to provide further security against tampering.

The closure of the present invention is preferably injection molded from plastic material to form a one, or two, piece assembly, whereby the door 16 may either be separate and thus comprise the second piece of the said assembly or be attached to the main body of closure 10.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A package for a food product including in combination a container for the food product having an access opening therein and a rim defined by surrounding sidewalls at one end of the container, and a removable closure for the access opening of the container engageable with the sidewalls comprising:

a compartment within said closure for accommodating a prize, said compartment having a predetermined first shape when the closure is on the container in engagement with the sidewalls of said one end, closing said access opening, and being deformable to a second shape by compression thereof when the closure is removed from the container;

panel disposed in an aperture in said compartment, secured in a closed position when the compartment has said first shape and moveable to an opened position in response to forces compressing the compartment to said second shape; and a skirt surrounding said compartment and defining an annular cavity for receiving said rim, said skirt being engageable with external surfaces of said surrounding sidewalls of said container when said closure is on said container to thereby preclude the compartment from being compressed to said second shape.

2. The package of claim 1 wherein panel includes a disc which is force-fit into then aperture in said compartment when said compartment has said first shape, said disc popping out of said aperture when said compartment is compressed to achieve said second shape.

3. The package of claim 2 wherein said disc is connected to said compartment along one edge by a hinge.

4. The package of claim 2 wherein said disc is connected to said compartment by an extensible link.

5. The package of claim 2 wherein the container, closure and compartment are cylindrical and an inner wall of the compartment opposite said disc is dome-shaped, said inner wall providing a partition for isolating the interior of the compartment from the interior of the container.

6. The package of claim 5 wherein the dome-shaped inner wall is convex as viewed from the interior of the container when said compartment has said first shape and snaps over to a concave shape when the compartment is compressed to said second shape to assist in popping said disc out of said aperture.

7. The package of claim 2 wherein said disc is configured along a first edge portion to firmly engage an opposing edge of the aperture and at a second edge portion to less firmly engage an opposing edge of the aperture so that compression of said compartment pops the second edge out of said aperture and pivots the disc about said first edge.

8. The package of claim 1 wherein said compartment when having said first shape forms a plug for said closure which fills said access opening of the container.

9. The package of claim 1 wherein said panel is formed in an external end surface of the closure.

10. The package of claim 1 wherein said closure is formed from one integral piece of resilient material.

11. The package of claim 1 wherein said closure is molded from plastic.

12. The package of claim 1 wherein said panel is disposed in said aperture under tension by lateral stretching thereof when the closure is on said container and the tension is released when the closure is removed from the container.

13. The package of claim 12 further including resilient fingers disposed about the aperture in said compartment, said fingers pushing against an inner surface of the panel to thereby assist in the opening of the panel when the closure is removed from the container.

14. The package of claim 1 further including resilient fingers disposed about the aperture in said compartment, said fingers pushing against an inner surface of the panel to thereby assist in the opening of the panel when the closure is removed from the container.

15. A closure for use with a container, said container having an access opening and a rim at one end thereof defined by surrounding sidewalls engageable with said closure comprising:

a compartment within said closure for accommodating a prize, said compartment having a predetermined first shape when the closure is on the container in engagement with the sidewalls of said one end, closing said access opening, and being deformable to a second shape by compression thereof when the closure is removed from the container;

panel disposed in an aperture in said compartment, secured in a closed position when the compartment has said first shape and moveable to an opened position in response to forces compressing the compartment to said second shape; and a skirt surrounding said compartment and defining an annular cavity for receiving said rim, said skirt being engageable with external surfaces of said surrounding sidewalls of said container when said closure is on said container to thereby preclude the compartment from being compressed to said second shape.

16. The closure of claim 15 wherein panel includes a disc which is force-fit into the aperture in said compartment when said compartment has said first shape, said disc popping out of said aperture when said compartment is compressed to achieve said second shape.

17. The closure of claim 16 wherein said disc is connected to said compartment along one edge by a hinge.

18. The closure of claim 16 wherein said disc is connected to said compartment by an extensible link.

19. The closure of claim 16 wherein the container, closure and compartment are cylindrical and an inner wall of the compartment opposite said disc is dome-shaped, said interior wall providing a partition for isolating the interior of the compartment from the interior of the container.

20. The closure of claim 19 wherein the dome-shaped inner wall is convex as viewed from the interior of the container when said compartment has said first shape and snaps over to a concave shape when the compartment is compressed to said second shape to assist in popping said disc out of said aperture.

21. The closure of claim 16 wherein said disc is configured along a first edge portion to firmly engage an opposing edge of the aperture and at a second edge portion to less firmly engage an opposing edge of the aperture so that compression of said compartment pops the second edge out of the aperture and pivots the disc about said first edge.

22. The closure of claim 15 wherein said compartment when having said first shape forms a plug for said closure which fills said access opening of the container.

23. The closure of claim 15 wherein said panel is formed in an external end surface of the closure.

24. The closure of claim 15 wherein said closure is formed from one integral piece of resilient material.

25. The closure of claim 15 wherein said closure is molded from plastic.

26. The closure of claim 15 wherein said panel is disposed in said aperture under tension by lateral stretching thereof when the closure is on said container and the tension is released when the closure is removed from the container.

27. The closure of claim 26 further including resilient fingers disposed about the aperture in said compartment, said fingers pushing against an inner surface of the panel to thereby assist in the opening of the panel when the closure is removed from the container.

28. The closure of claim 15 further including resilient fingers disposed about the aperture in said compartment, said fingers pushing against an inner surface of the panel to thereby assist in the opening of the panel when the closure is removed from the container.

29. A closure for a beverage bottle comprising:

a cylindrical housing having a partially closed end defining an access opening and an open end, said open end being capable of removably engaging a finish surrounding an opening in the beverage bottle;

a compartment mounted within the cylindrical housing and extending into the opening of the beverage bottle, said cylindrical housing having a closed end wall and sidewalls extending therefrom to the partially closed end of the cylindrical housing, said closure having a predetermined first shape when the closure is in engagement with said finish, and being deformable to a second shape by compression thereof when the closure is out of engagement with said finish;

panel covering said access opening in said cylindrical housing secured in a closed position when the closure has said first shape and moveable to an opened position in response to forces compressing the closure to the second shape; and a skirt surrounding said compartment and defining an annular cavity for receiving said finish, said skirt being engageable with external surfaces of said surrounding sidewall of said container when said closure is on said container to thereby preclude the compartment from being compressed to said second shape.

30. The closure of claim 24 wherein said panel includes a disc which is force-fit into said access opening when the closure has said first shape, said disc popping out of said access opening when the closure is compressed to achieve the second shape.

31. The closure of claim 30 wherein said disc is connected to the closed end of the closure by a hinge.

32. The closure of claim 30 wherein said disc is connected to the closure by an extensible link.

33. The closure of claim 32 wherein said disc is configured along a first edge portion to firmly engage an opposing edge of the access opening and at a second edge portion to less firmly engage an opposing edge of the access opening so that compression of said compartment pops the second edge out of the access opening and pivots the disc about said first edge.

34. The closure of claim 32 wherein said panel is disposed in said access opening under tension by lateral stretching thereof when the closure is on said container and the tension is released when the closure is removed from the container.

35. The closure of claim 34 further including resilient fingers disposed about the access opening in said compartment said fingers pushing against an inner surface of the panel to thereby assist in the opening of the panel when the closure is removed from the container.

36. The closure of claim 32 further including resilient fingers disposed about the access opening in said compartment said fingers pushing against an inner surface of the panel to thereby assist in the opening of the panel when the closure is removed from the container.

37. The closure of claim 29 wherein the container, closure and compartment are cylindrical and an inner wall of the compartment opposite said disc is dome-shaped, said interior wall providing a partition for isolating the interior of the compartment from the interior of the container.

38. The closure of claim 37 wherein the dome-shaped inner wall is convex as viewed from the interior of the container when said compartment has said first shape and snaps over to a concave shape when the compartment is compressed to said second shape to assist in popping said disc out of said aperture.

39. A package for a food product including in combination a container for the food product having an access opening therein and a rim defined by surrounding sidewalls at one end of the container, and a removable closure for the access opening of the container engageable with the sidewalls comprising:

a compartment within said closure for accommodating a prize, said compartment having a predetermined first shape when the closure is on the container in engagement with the sidewalls of said one end, closing said access opening, and being deformable to a second shape by compression thereof when the closure is removed from the container; and panel disposed in an aperture in said compartment, secured in a closed position when the compartment has said first shape, and moveable to an opened position in response to forces compressing the compartment to said second shape, said panel being disposed in said aperture under tension by lateral stretching thereof when the closure is on said container and the tension is released when the closure is removed from the container.

40. The package of claim 39 further including resilient fingers disposed about the aperture in said compartment, said fingers pushing against an inner surface of the panel to thereby assist in the opening of the panel when the closure is removed from the container.

41. A package for a food product including in combination a container for the food product having an access opening therein and a rim defined by surrounding sidewalls at one end of the container, and a removable closure for the access opening of the container engageable with the sidewalls comprising:

a compartment within said closure for accommodating a prize, said compartment having a predetermined first shape when the closure is on the container in engagement with the sidewalls of said one end, closing said access opening, and being deformable to a second shape by compression thereof when the closure is removed from the container;

panel disposed in an aperture in said compartment, secured in a closed position when the compartment has said first shape and moveable to an opened position in response to forces compressing the compartment to said second shape; and resilient fingers disposed about the aperture in said compartment, said fingers pushing against an inner surface of the panel to thereby assist in the opening of the panel means when the closure is removed from the container.

42. A package for a food product including in combination a container for the food product having an access opening therein and a rim defined by surrounding sidewalls at one end of the container, and a removable closure for the access opening of the container engageable with the sidewalls, comprising:

a compartment within said closure for accommodating a prize, said compartment having a predetermined first shape when the closure is on the container in engagement with the sidewalls of said one end, closing said access opening, and being deformable to a second shape by compression thereof when the closure is removed from the container; and panel disposed in an aperture in said compartment, secured in a closed position when the compartment has said first shape, and moveable to an opened position in response to forces compressing the compartment to said second shape, said panel including a disc which is force-fit into the aperture in said compartment when said compartment has said first shape, said disc popping out of said aperture when said compartment is compressed to achieve said second shape;

wherein the container, closure and compartment are cylindrical and an inner wall of the compartment opposite said disc is dome-shaped, said inner wall providing a partition for isolating the interior of the compartment from the interior of the container, said dome-shaped inner wall being convex as viewed from the interior of the container when said compartment has said first shape and snaps over to a concave shape, when the compartment is compressed to said second shape to assist in popping said disc out of said aperture.

* * * * *